US009206738B2

(12) United States Patent
Sturman

(10) Patent No.: US 9,206,738 B2
(45) Date of Patent: Dec. 8, 2015

(54) FREE PISTON ENGINES WITH SINGLE HYDRAULIC PISTON ACTUATOR AND METHODS

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 0 days.

(21) Appl. No.: 13/526,914

(22) Filed: Jun. 19, 2012

(65) Prior Publication Data

US 2012/0318239 A1 Dec. 20, 2012

Related U.S. Application Data

(60) Provisional application No. 61/499,049, filed on Jun. 20, 2011.

(51) Int. Cl.

| | |
|---|---|
| ***F02B 71/00*** | (2006.01) |
| ***F02B 71/04*** | (2006.01) |
| ***F01B 11/00*** | (2006.01) |
| ***F04B 19/00*** | (2006.01) |

(52) U.S. Cl.
CPC ..... *F02B 71/045* (2013.01); *F01B 11/007* (2013.01); *F04B 19/003* (2013.01)

(58) Field of Classification Search
CPC .... F02B 71/00; F02B 2075/025; F02B 71/06; F04B 19/003
USPC ..... 123/46 A, 46 R, 46 B, 46 E
See application file for complete search history.

(56) References Cited

U.S. PATENT DOCUMENTS

| | | | |
|---|---|---|---|
| 1,062,999 | A | 5/1913 | Webb |
| 2,058,705 | A | 10/1936 | Maniscalco |

(Continued)

FOREIGN PATENT DOCUMENTS

| | | |
|---|---|---|
| CN | 101225765 | 7/2008 |
| CN | 101495730 | 7/2009 |

(Continued)

OTHER PUBLICATIONS

"International Search Report and Written Opinion of the International Searching Authority Dated Jan. 20, 2011", International Application No. PCT/US2010/052391.

(Continued)

*Primary Examiner* — Lindsay Low
*Assistant Examiner* — Long T Tran
(74) *Attorney, Agent, or Firm* — Blakely Sokoloff Taylor & Zafman LLP

(57) ABSTRACT

Free piston engines having a free piston having a first piston diameter in a cylinder with a combustion chamber on a first side of the first piston and a piston rod having a second diameter fastened to a second side of the first piston and extending to a single second piston having a third diameter smaller than the first diameter, but larger that the second diameter, the single second piston extending into a hydraulic cylinder, the second piston having a first hydraulic area defined by the third diameter in a first hydraulic chamber, and a second hydraulic area defined by the area between the third diameter and the second diameter in a second hydraulic chamber, and valving to control the coupling of a high pressure, a low pressure and a reservoir to the first and second hydraulic chambers to control the free piston.

19 Claims, 3 Drawing Sheets

(56) References Cited

U.S. PATENT DOCUMENTS 2,661,592 A 12/1953 Bright
2,902,207 A 9/1959 Burion
3,065,703 A 11/1962 Harman
3,170,406 A 2/1965 Robertson
3,209,737 A 10/1965 Omotehara et al.
3,532,121 A 10/1970 Sturman et al.
3,623,463 A 11/1971 De Vries
3,683,239 A 8/1972 Sturman
3,743,898 A 7/1973 Sturman
3,859,966 A 1/1975 Braun
3,931,845 A * 1/1976 Dixon ..... 157/1.22
3,952,710 A 4/1976 Kawarada et al.
3,995,974 A 12/1976 Herron
4,009,695 A 3/1977 Ule
4,097,198 A 6/1978 Herron
4,162,662 A 7/1979 Melchior
4,192,265 A 3/1980 Amano
4,312,038 A 1/1982 Imai et al.
4,326,380 A 4/1982 Rittmaster et al.
4,333,424 A 6/1982 McFee
4,396,037 A 8/1983 Wilcox
4,403,474 A 9/1983 Ruthven
4,409,638 A 10/1983 Sturman et al.
4,435,133 A 3/1984 Meulendyk
RE32,163 E 5/1986 Tokuda et al.
4,599,861 A 7/1986 Beaumont
4,779,582 A 10/1988 Lequesne
4,783,966 A 11/1988 Aldrich
4,887,562 A 12/1989 Wakeman
4,906,924 A 3/1990 Zannis
4,930,464 A 6/1990 Letsche
5,003,937 A 4/1991 Matsumoto et al.
5,022,358 A 6/1991 Richeson
5,121,730 A 6/1992 Ausman et al.
5,124,598 A 6/1992 Kawamura
5,170,755 A 12/1992 Kano et al.
5,193,495 A 3/1993 Wood, III
5,209,453 A 5/1993 Aota et al.
5,224,683 A 7/1993 Richeson
5,237,968 A 8/1993 Miller et al.
5,237,976 A 8/1993 Lawrence et al.
5,248,123 A 9/1993 Richeson et al.
5,255,641 A 10/1993 Schechter
5,275,134 A 1/1994 Springer
5,275,136 A 1/1994 Schechter et al.
5,327,856 A 7/1994 Schroeder et al.
5,331,277 A 7/1994 Burreson
5,335,633 A 8/1994 Thien
5,339,777 A 8/1994 Cannon
5,363,651 A 11/1994 Knight
5,367,990 A 11/1994 Schechter
5,373,817 A 12/1994 Schechter et al.
5,408,975 A 4/1995 Blakeslee et al.
5,410,994 A 5/1995 Schechter
5,419,286 A 5/1995 Edison et al.
5,419,492 A 5/1995 Gant et al.
5,421,521 A 6/1995 Gibson et al.
5,448,973 A 9/1995 Meyer
5,460,329 A 10/1995 Sturman
5,463,996 A 11/1995 Maley et al.
5,471,959 A 12/1995 Sturman
5,473,893 A 12/1995 Achten et al.
5,482,445 A 1/1996 Achten et al.
5,494,219 A 2/1996 Maley et al.
5,499,605 A 3/1996 Thring
5,507,316 A 4/1996 Meyer
5,526,778 A 6/1996 Springer
5,540,193 A 7/1996 Achten et al.
5,546,897 A 8/1996 Brackett
5,551,398 A 9/1996 Gibson et al.
5,556,262 A 9/1996 Achten et al.
5,572,961 A 11/1996 Schechter et al.
5,577,468 A 11/1996 Weber
5,598,871 A 2/1997 Sturman et al.
5,622,152 A 4/1997 Ishida
5,628,293 A 5/1997 Gibson et al.
5,638,781 A 6/1997 Sturman
5,640,987 A 6/1997 Sturman
5,647,734 A 7/1997 Milleron
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,700,136 A 12/1997 Sturman
5,713,316 A 2/1998 Sturman
5,720,261 A 2/1998 Sturman et al.
5,732,677 A 3/1998 Baca
5,738,075 A 4/1998 Chen et al.
5,752,659 A 5/1998 Moncelle
5,813,841 A 9/1998 Sturman
5,829,393 A 11/1998 Achten et al.
5,829,396 A 11/1998 Sturman
5,857,436 A 1/1999 Chen
5,873,526 A 2/1999 Cooke
5,894,730 A 4/1999 Mitchell
5,937,799 A 8/1999 Binion
5,954,030 A 9/1999 Sturman et al.
5,960,753 A 10/1999 Sturman
5,970,956 A 10/1999 Sturman
5,979,803 A 11/1999 Peters et al.
5,983,638 A 11/1999 Achten et al.
6,005,763 A 12/1999 North
6,012,430 A 1/2000 Cooke
6,012,644 A 1/2000 Sturman et al.
6,085,991 A 7/2000 Sturman
6,105,616 A 8/2000 Sturman et al.
6,109,284 A 8/2000 Johnson et al.
6,135,069 A 10/2000 Fenelon et al.
6,148,778 A 11/2000 Sturman
6,152,091 A 11/2000 Bailey et al.
6,158,401 A 12/2000 Bailey
6,161,770 A 12/2000 Sturman
6,170,442 B1 1/2001 Beale
6,173,685 B1 1/2001 Sturman
6,206,656 B1 3/2001 Bailey et al.
6,257,499 B1 7/2001 Sturman
6,269,783 B1 * 8/2001 Bailey ..... 123/46 R
6,279,517 B1 8/2001 Achten
6,308,690 B1 10/2001 Sturman
6,314,924 B1 * 11/2001 Berlinger ..... 123/46 R
6,360,728 B1 3/2002 Sturman
6,412,706 B1 7/2002 Guerrassi et al.
6,415,749 B1 7/2002 Sturman et al.
6,463,895 B2 * 10/2002 Bailey ..... 123/46 R
6,497,216 B2 12/2002 Gaessler et al.
6,543,411 B2 4/2003 Raab et al.
6,551,076 B2 4/2003 Boulware
6,557,506 B2 5/2003 Sturman
6,575,126 B2 6/2003 Sturman
6,575,384 B2 6/2003 Ricco
6,592,050 B2 7/2003 Boecking
6,655,355 B2 12/2003 Kropp et al.
6,684,856 B2 2/2004 Tanabe et al.
6,684,857 B2 2/2004 Boecking
6,739,293 B2 5/2004 Turner et al.
6,769,405 B2 8/2004 Leman et al.
6,863,507 B1 3/2005 Schaeffer et al.
6,910,462 B2 6/2005 Sun et al.
6,910,463 B2 6/2005 Oshizawa et al.
6,925,971 B1 8/2005 Peng et al.
6,931,845 B2 * 8/2005 Schaeffer ..... 60/413
6,948,459 B1 9/2005 Laumen et al.
6,951,204 B2 10/2005 Shafer et al.
6,951,211 B2 10/2005 Bryant
6,953,010 B1 10/2005 Hofbauer
6,957,632 B1 10/2005 Carlson
6,971,341 B1 12/2005 Fuqua et al.
6,983,724 B2 1/2006 Carlson
6,994,077 B2 2/2006 Kobayashi et al.
6,999,869 B1 2/2006 Gitlin et al.
7,025,326 B2 4/2006 Lammert et al.
7,032,548 B2 4/2006 Tusinean
7,032,574 B2 4/2006 Sturman

(56) References Cited

U.S. PATENT DOCUMENTS

| | | | | |
|---|---|---|---|---|
| 7,108,200 | B2 | 9/2006 | Sturman | |
| 7,128,062 | B2 | 10/2006 | Kuo et al. | |
| 7,182,068 | B1 | 2/2007 | Sturman et al. | |
| 7,258,086 | B2 | 8/2007 | Fitzgerald | |
| 7,341,028 | B2 | 3/2008 | Klose et al. | |
| 7,353,786 | B2 | 4/2008 | Scuderi et al. | |
| 7,387,095 | B2 | 6/2008 | Babbitt et al. | |
| 7,412,969 | B2 | 8/2008 | Pena et al. | |
| 7,481,039 | B2 | 1/2009 | Surnilla et al. | |
| 7,568,632 | B2 | 8/2009 | Sturman | |
| 7,568,633 | B2 | 8/2009 | Sturman | |
| 7,694,891 | B2 | 4/2010 | Sturman | |
| 7,717,359 | B2 | 5/2010 | Sturman | |
| 7,730,858 | B2 | 6/2010 | Babbitt et al. | |
| 7,793,638 | B2 | 9/2010 | Sturman | |
| 7,954,472 | B1 | 6/2011 | Sturman | |
| 7,958,864 | B2 | 6/2011 | Sturman | |
| 8,196,844 | B2 | 6/2012 | Kiss et al. | |
| 8,276,550 | B1 | 10/2012 | Noguchi et al. | |
| 8,282,020 | B2 | 10/2012 | Kiss et al. | |
| 8,327,831 | B2 | 12/2012 | Sturman | |
| 8,342,153 | B2 | 1/2013 | Sturman | |
| 8,499,728 | B2 | 8/2013 | Xie et al. | |
| 8,549,854 | B2 | 10/2013 | Dion et al. | |
| 8,887,690 | B1 | 11/2014 | Sturman | |
| 2001/0017123 | A1 | 8/2001 | Raab et al. | |
| 2001/0020453 | A1 | 9/2001 | Bailey | |
| 2002/0017573 | A1 | 2/2002 | Sturman | |
| 2002/0073703 | A1 | 6/2002 | Bailey | |
| 2002/0076339 | A1 | 6/2002 | Boulware | |
| 2002/0166515 | A1 | 11/2002 | Ancimer et al. | |
| 2003/0015155 | A1 | 1/2003 | Turner et al. | |
| 2003/0041593 | A1 | 3/2003 | Yoshida et al. | |
| 2003/0226351 | A1 | 12/2003 | Glenn | |
| 2004/0045536 | A1 | 3/2004 | Hafner et al. | |
| 2004/0177837 | A1 | 9/2004 | Bryant | |
| 2005/0098162 | A1 | 5/2005 | Bryant | |
| 2005/0247273 | A1* | 11/2005 | Carlson | 123/46 R |
| 2006/0032940 | A1 | 2/2006 | Boecking | |
| 2006/0042575 | A1 | 3/2006 | Schmuecker et al. | |
| 2006/0192028 | A1 | 8/2006 | Kiss | |
| 2006/0243253 | A1 | 11/2006 | Knight | |
| 2007/0007362 | A1 | 1/2007 | Sturman | |
| 2007/0113906 | A1 | 5/2007 | Sturman et al. | |
| 2007/0245982 | A1 | 10/2007 | Sturman | |
| 2008/0092860 | A2 | 4/2008 | Bryant | |
| 2008/0264393 | A1 | 10/2008 | Sturman | |
| 2008/0275621 | A1 | 11/2008 | Kobayashi | |
| 2009/0037085 | A1 | 2/2009 | Kojima | |
| 2009/0183699 | A1 | 7/2009 | Sturman | |
| 2009/0199789 | A1 | 8/2009 | Beard | |
| 2009/0199819 | A1 | 8/2009 | Sturman | |
| 2009/0250035 | A1 | 10/2009 | Washko | |
| 2009/0271088 | A1 | 10/2009 | Langham | |
| 2010/0012745 | A1 | 1/2010 | Sturman | |
| 2010/0186716 | A1 | 7/2010 | Sturman | |
| 2010/0229838 | A1 | 9/2010 | Sturman | |
| 2010/0275884 | A1* | 11/2010 | Gray, Jr. | 123/46 R |
| 2010/0277265 | A1 | 11/2010 | Sturman et al. | |
| 2010/0288249 | A1 | 11/2010 | Sasaki et al. | |
| 2010/0307432 | A1 | 12/2010 | Xie et al. | |
| 2011/0011354 | A1 | 1/2011 | Dincer et al. | |
| 2011/0083643 | A1* | 4/2011 | Sturman et al. | 123/46 R |
| 2011/0163177 | A1 | 7/2011 | Kiss | |
| 2012/0080110 | A1 | 4/2012 | Kiss et al. | |

FOREIGN PATENT DOCUMENTS

| | | |
|---|---|---|
| DE | 37 27 335 | 2/1988 |
| DE | 4024591 | 2/1992 |
| DE | 10239110 | 3/2004 |
| FR | 2901846 | 12/2007 |
| GB | 941453 | 11/1963 |
| GB | 2402169 | 12/2004 |
| JP | 60-035143 | 2/1985 |
| WO | WO-92/02730 | 2/1992 |
| WO | WO-93/10344 | 5/1993 |
| WO | WO-97/35104 | 9/1997 |
| WO | WO-98/11334 | 3/1998 |
| WO | WO-98/54450 | 12/1998 |
| WO | WO-01/46572 | 6/2001 |
| WO | WO-02/086297 | 10/2002 |
| WO | WO-2008/014399 | 1/2008 |

OTHER PUBLICATIONS

"International Search Report and Written Opinion of the International Searching Authority Dated Apr. 18, 2013, International Application No. PCT/US2012/047805".

"International Search Report and Written Opinion of the International Searching Authority Dated Jan. 31, 2013, International Application No. PCT/US2012/043393".

"Office Action Dated Apr. 12, 2013; U.S. Appl. No. 12/901,915".

"Office Action Dated Oct. 1, 2012, U.S. Appl. No. 12/901,915".

"Partial International Search Report and Invitation to Pay Additional Fees by the International Searching Authority Dated Feb. 6, 2013, International Application No. PCT/US2012/047805".

Alson, Jeff , et al., "Progress Report on Clean and Efficient Automotive Technologies Under Development at the EPA", *United States Environmental Protection Agency, EPA420-R-04-002*, (Jan. 2004), 198 pp total.

Anderson, Mark D., et al., "Adaptive Lift Control for a Camless Electrohydraulic Valvetrain", *SAE Paper* No. 981029, U. of Illinois and Ford Motor Co., (Feb. 23, 1998).

Blair, Gordon P., "Design and Simulation of Two-Stroke Engines", *SAE Publications No. R-161*, (1996), pp. 1-48

Brueckner, Stephen , "Reducing Greenhouse Gas Emissions From Light-Duty Motor Vehicles", *California Air Resources Board (ARB) Workshop*, (Apr. 20, 2004), pp. 1-37.

Challen, Bernard , "Diesel Engine Reference Book Second Edition", *SAE Publication No. R-183*, (1999), pp. 27-71.

Cole, C. , et al., "Application of Digital Valve Technology to Diesel Fuel Injection", *SAE Paper No. 1999-01-0196*, Sturman Industries, Inc., (Mar. 1, 1999).

Dickey, Daniel W., et al., "NOx Control in Heavy-Duty Diesel Engines—What is the Limit?", *In-Cylinder Diesel Particulate and NOx Control*, SAE Publication No. SP-1326, (1998), pp. 9-20.

Duret, P. , "A New Generation of Two-Stroke Engines for the Year 2000", *A New Generation of Two-Stroke Engines for the Future?*, Paris, (1993), pp. 181-194.

Heisler, Heinz , "Vehicle and Engine Technology Second Edition", *SAE International*, London, (1999), pp. 292-308

Kang, Kern Y., "Characteristics of Scavenging Flow in a Poppet-Valve Type 2-Stroke Diesel Engine by Using RSSV System", *Progress in Two-Stroke Engine and Emissions Control*, SAE Publication SP-1131, (1998), pp. 93-101.

Kang, Hyungsuk , et al., "Demonstration of Air-Power-Assist (APA) Engine Technology for Clean Combustion and Direct Energy Recovery in Heavy Duty Application", *SAE Technical Paper Series 2008-01-1197*, (Apr. 14-17, 2008), 9 pp total.

Kim, Dean H., et al., "Dynamic Model of a Springless Electrohydraulic Valvetrain", *SAE Paper No. 970248*, U. of Illinois and Ford Research Company, (1997).

Misovec, Kathleen M., et al., "Digital Valve Technology Applied to the Control of an Hydraulic Valve Actuator", *SAE Paper No. 1999-01-0825*, Sturman Industries, Inc., (Mar. 1, 1999)

Nehmer, Daniel A., et al., "Development of a Fully Flexible Hydraulic Valve Actuation Engine, Part I: Hydraulic Valve Actuation System Development", *Proceedings of the 2002 Global Powertrain Congress (GPC) on Advanced Engine Design and Performance*, (2002), 12 pp total.

Nomura, K. , et al., "Development of a New Two-Stroke Engine with Poppet-Valves: Toyota S-2 Engine", *A New Generation of Two-Stroke Engines for the Future?*, (1993), pp. 53-62.

Nuti, Marco , et al., "Twenty Years of Piaggio Direct Injection Research to Mass Produced Solution for Small 2T SI Engines", *Two-Stroke Engines and Emissions*, SAE Publication SP-1327, (1998), pp. 65-78.

(56) References Cited

OTHER PUBLICATIONS

Osenga, Mike , "Cat's HEUI System: A Look at the Future?", *Diesel Progress*, (Apr. 1995), pp. 30-35.
Ricardo, Inc., "A Study of Potential Effectiveness of Carbon Dioxide Reducing Vehicle Technologies, Revised Final Report", *United States Environmental Protection Agency EPA420-R-08-004A*, EPA Contract No. EP-C-06-003, Work Assignment No.1-14, (Jun. 2008), 126 pp total.
Schechter, Michael M., et al., "Camless Engine", *SAE Paper No. 960581*, Ford Research Lab, (Feb. 26, 1996).
Sheehan, John , et al., "An Overview of Biodiesel and Petroleum Diesel Life Cycles", A Joint Study Sponsored by: U.S. Department of Agriculture and U.S. Department of Energy, (May 1998), 60 pp total.
Sturman, Carol , et al., "Breakthrough in Digital Valves", *Machine Design*, (Feb. 21, 1994), pp. 37-42.
Vance, Evelyn , et al., "Advanced Fuel Injection System and Valve Train Technologies", SBIR Phase II Project Final Report, SBIR Contract No. W56HZV-07-C-0528, (Oct. 19, 2009), pp. 1-237.
Wilson, Rob , "Developments in Digital Valve Technology", *Diesel Progress North American Edition*, (Apr. 1997), pp. 76, 78-79
Wirbeleit, F. , et al., "Stratified Diesel Fuel-Water-Diesel Fuel Injection Combined with EGR—The Most Efficient In-Cylinder NOx and PM Reduction Technology", *Combustion and Emissions in Diesel Engines*, SAE Publication No. SP-1299, (1997), pp. 39-44.
Yamaguchi, T. , et al., "Improvements for Volumetric Efficiency and Emissions using Digital Hydraulic VVA in a High Boosting Diesel Engine", *THIESEL 2008 Conference on Thermo- and Fluid Dynamic Processes in Diesel Engines*, (2008), pp. 1-13.
"Notice of Allowance Mailed Jul. 16, 2013; U.S. Appl. No. 12/901,915".
"Office Action Dated Feb. 28, 2014; U.S. Appl. No. 13/181,437".
"Office Action Dated Dec. 3, 2013; Chinese Patent Application No. 201080054641.5".
"Notice of Allowance Dated Jun. 5, 2014; U.S. Appl. No. 13/181,437".
"Office Action Dated Jul. 11, 2014; Chinese Patent Application No. 201080054641.5".
"Office Action Dated Jun. 16, 2014; U.S. Appl. No. 13/554,123".
"Office Action Dated Feb. 9, 2015; U.S. Appl. No. 13/554,123".
"Office Action Dated Sep. 30, 2015; U.S. Appl. No. 13/554,123", (Sep. 30, 2015).

* cited by examiner

ACCU. HIGH
ACCU. LOW
RESV
3W
EXH.
INJ.
INT.
20
22
24
26
28
30
32
34
36
38
40
42

FREE PISTON ENGINES WITH SINGLE HYDRAULIC PISTON ACTUATOR AND METHODS

CROSS-REFERENCE TO RELATED APPLICATIONS

This application claims the benefit of U.S. Provisional Patent Application No. 61/499,049 filed Jun. 20, 2011.

BACKGROUND OF THE INVENTION

1. Field of the Invention

The present invention relates to the field of free piston engines.

2. Prior Art

Various types of free piston engines are well known in the prior art. Of particular relevance to the present invention are the free piston engines and methods disclosed in U.S. Patent Application Publication No. 2011/0083643, the disclosure of which is hereby incorporated by reference. Those engines utilize a high pressure hydraulic rail and a low pressure hydraulic rail and a plurality of hydraulic pistons and valving to controllably couple the hydraulic pistons to the high pressure hydraulic rail or the low pressure hydraulic rail. In each cylinder a central hydraulic piston is connected to the free piston and configured so as to draw the free piston away from the top dead center position, such as during an intake stroke, or to exert a force on the free piston toward the top dead center position, such as during a compression stroke or a power stroke during which hydraulic energy is delivered to the high pressure rail. The additional hydraulic pistons are symmetrically distributed around the center hydraulic piston and may be controllably coupled to the high pressure rail or the low pressure rail as appropriate for a compression stroke, and the output of hydraulic energy to the high pressure rail during a power stroke as appropriate to control the free piston velocities, excursion, etc.

DETAILED DESCRIPTION OF THE PREFERRED EMBODIMENTS

In any free piston engine the task is to control the free piston motion during each stroke of its operating cycle and to recover the energy output of the free piston in an efficient manner. Of particular importance are the top dead center and bottom dead center positions of the piston and its velocity profile therebetween. In the free piston engines described in the U.S. published application hereinbefore referred to, the position of the free piston is sensed and from that information the top dead center and the bottom dead center positions of the piston may be controlled, as well as the velocity profile of the free piston, throughout all strokes of the operating cycle. This is done by coupling the hydraulic pistons to the high pressure rail or the low pressure rail in combinations to provide the desired force on the free piston for that particular stroke. By way of example, for a power stroke all hydraulic pistons might initially be coupled to the high pressure rail to deliver high pressure hydraulic fluid thereto, with hydraulic pistons being switched to the low pressure rail as the combustion chamber pressure drops and the free piston slows.

In an exemplary embodiment a central hydraulic piston and six additional hydraulic pistons distributed symmetrically around the center hydraulic piston are used. For a relative force of seven on the free piston toward the top dead center position all seven hydraulic cylinders would be coupled to the high pressure rail, for a relative force of six all except the center piston would be coupled to the high pressure rail, for a relative force of five the center piston and four of the surrounding symmetrically located pistons would be coupled to the high pressure rail, etc. Note that if one uses all combinations during a power stroke, each hydraulic piston will be switched between the high pressure and low pressure rails a number of times during that power stroke. While this may not be necessary, it does illustrate the point that one (or a pair) of hydraulic cylinders may need to be switched between the high and low rails (or accumulators) more than once during any one stroke of the free piston.

Figure 1:
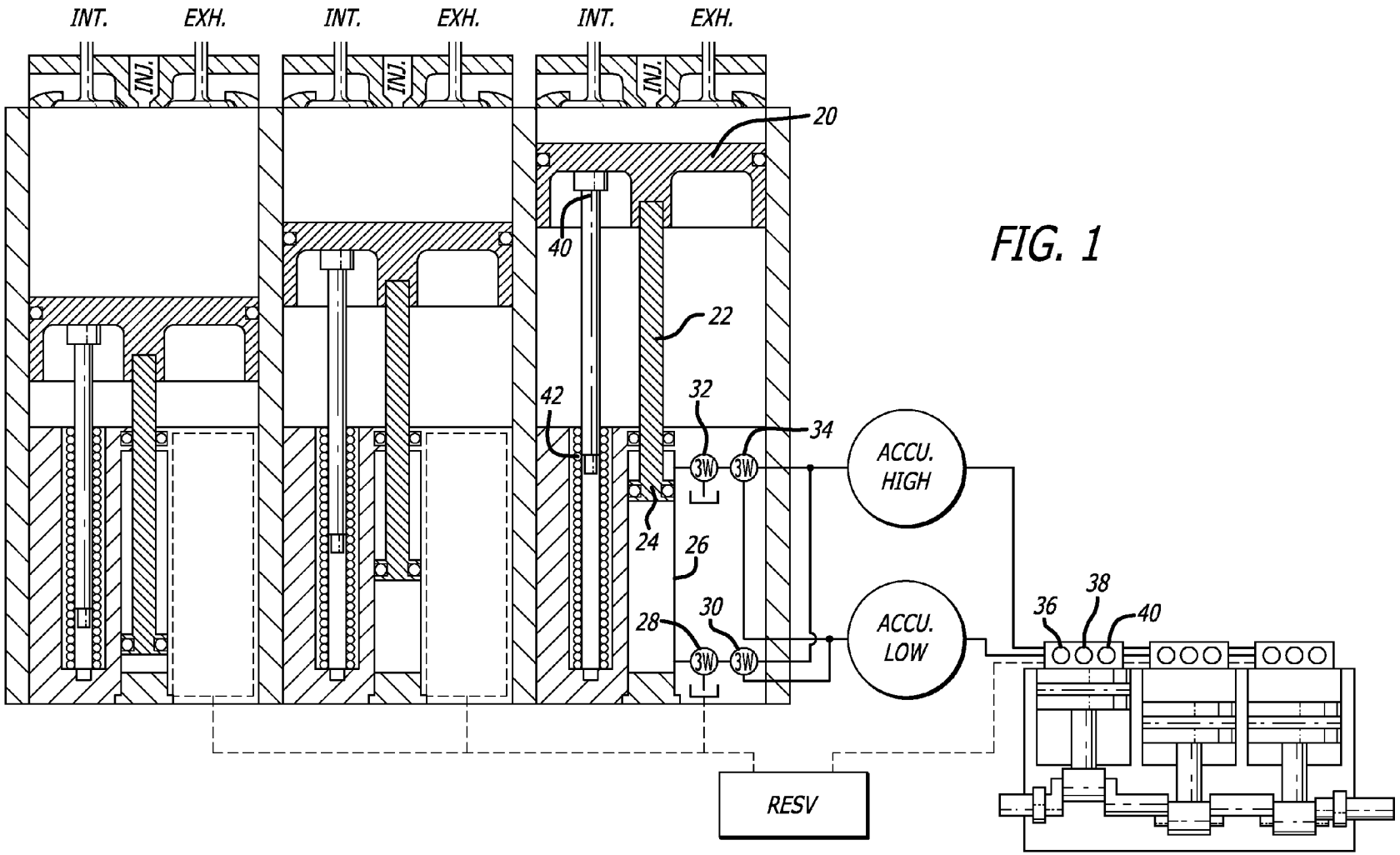
FIG. 1 illustrates an embodiment of the present invention.

In accordance with the present invention, the ability to operate the valves in a time period which is much shorter than an individual stroke of the free piston makes feasible the modulation of the valving between coupling to the high pressure rail or accumulator and the low pressure rail or accumulator, and to the vent (reservoir). As shown in FIG. 1, for each piston of the free piston engine, the free piston 20 has a center piston rod 22 coupled to a hydraulic piston 24 in a hydraulic cylinder 26. As in the published application, the injector INJ and the intake and exhaust valves INT and EXH would all be electronically controlled, hydraulically actuated as described in the published application.

Figure 2:
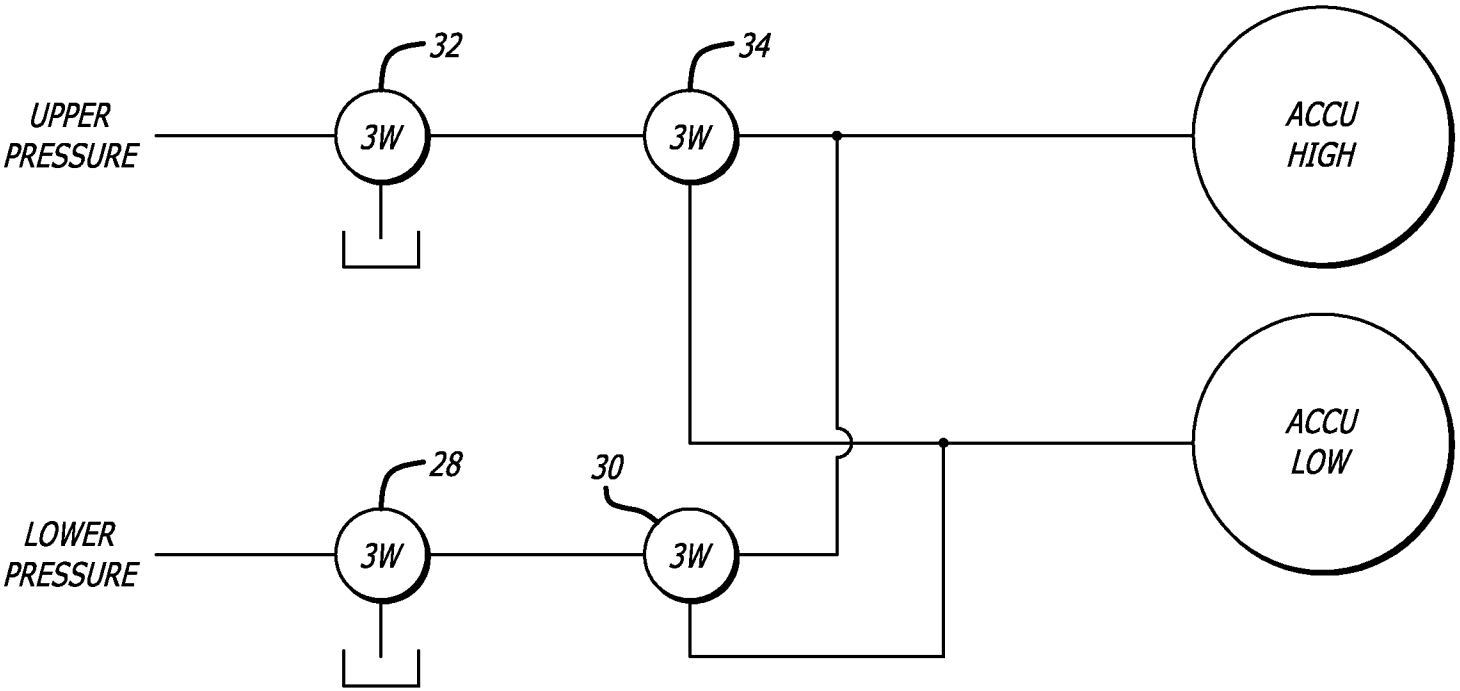
FIG. 2 better illustrates the exemplary valving for the embodiment of FIG. 1.

The region below the hydraulic piston 24 is coupled to first and second three-way valves 28 and 30 and the region above hydraulic piston 24 is coupled to three-way hydraulic valves 32 and 34. FIG. 2 is an expanded illustration of the three-way valves 28, 30, 32 and 34 and their interconnection. In particular, the region in cylinder 26 below piston 24 ("lower pressure" in FIG. 2) may be coupled to the reservoir RESV or to the three-way valve 30 by three-way valve 28, which in turn may direct the fluid flow to or from the high pressure accumulator ACCU HIGH or to or from the low pressure accumulator ACCU LOW. Similarly, the region in cylinder 26 above hydraulic piston 24 ("upper pressure" in FIG. 2) may be coupled to the reservoir RESV or to three-way valve 34 by three-way valve 32, with three-way valve 34 coupling the flow from three-way valve 32 to or from the high pressure accumulator ACCU HIGH or the low pressure accumulator ACCU LOW. Note that the same valving is repeated for each free piston, though it is only shown for one free piston in FIG. 1 for clarity.

For relative values, the reservoir RESV may be, by way of example, open to the atmosphere, i.e., at atmospheric pressure, whereas the pressure in the accumulator ACCU LOW preferably will be significantly above atmospheric pressure, and most preferably at least high enough to backfill the hydraulic volumes on either side of the hydraulic piston 24 when the same is moving in a direction to require such backfilling. The pressure of the high pressure rail or accumulator ACCU HIGH will be quite high in comparison to the low pressure accumulator ACCU LOW, and may be, by way of example, on the order of a thousand bar.

It will be noted that the hydraulic area above hydraulic piston 24 is equal to the area of hydraulic piston 24 minus the cross-sectional area of the free piston rod 22. Thus the same pressure in the hydraulic region above hydraulic piston 24 will cause a substantially lower downward force on the free piston 20 than the upward force the same hydraulic pressure in hydraulic cylinder 26 below hydraulic piston 24 will cause. However less downward force will generally be needed to be exerted on the free piston 20, as this is required generally only for an intake stroke, whereas the upward force required must be adequate for the compression stroke and of course adequate to absorb the hydraulic energy during the combustion or power stroke.

Typically the three-way valves 28, 30, 32 and 34 will be two-stage valves, the first stage being electronically controllable, with the second stage being hydraulically actuated by the first stage, though valves of other configurations may also be used, provided they have a sufficient operating speed.

In operation, when one side of the hydraulic piston 24 is not to be pressurized the corresponding three-way valve 28 or 32 will couple the same to the reservoir RESV. For the side of the hydraulic piston 24 to be pressurized, the three-way valve 28 or 32 will couple the corresponding hydraulic region to one of three-way valves 30 and 34, which will alternate between coupling flow to the high pressure accumulator ACCU HIGH and the low pressure accumulator ACCU LOW at a high speed and with varying timing so that the average force on the hydraulic piston 24 during the corresponding time interval approximates the desired force. For this purpose, it is particularly important that the three-way valves 30 and 34 are carefully designed to avoid a momentary hydraulic lock when switching between their two valve positions, yet at the same time avoid any substantial direct coupling between the high pressure accumulator and the low pressure accumulator. The hydraulic lock or a near hydraulic lock consideration is also important for the three-way valves 28 and 32, though those valves would normally switch at or around the top dead center and bottom dead center positions of the free piston where velocities and flow rates are not substantial, though the short circuit possibilities between either accumulator or either accumulator and the vent is still a particular concern.

Referring again to FIG. 1, an exemplary hydraulic pump motor which may be used with the free piston engine of FIG. 1 may be seen. As shown therein the exemplary hydraulic pump motor is a piston/crankshaft type pump motor with three control valves 36, 38 and 40 for each piston to controllably couple the same to the high pressure accumulator ACCU HIGH, the low pressure accumulator ACCU LOW or the reservoir RESV. Typically for shaft power output, the valves would be controlled so that a cylinder of the pump motor would be coupled to the high pressure accumulator ACCU HIGH during a power stroke, or otherwise to the low pressure accumulator ACCU LOW or to the reservoir RESV. For no power output with the pump motor crankshaft turning, such as by being coupled to the wheels of a vehicle that is moving, a cylinder of the pump motor would be coupled to the low pressure accumulator ACCU LOW during both strokes to keep the cylinder filled with hydraulic fluid but to not deliver any power to the wheels. For recovery of energy, such as during regenerative engine braking, one or more cylinders of the pump motor would be coupled to the low pressure accumulator ACCU LOW during what would normally be the power stroke to keep the cylinder filled with hydraulic fluid, and to the high pressure accumulator ACCU HIGH during a return stroke to return much more hydraulic energy to the high pressure accumulator than provided from the low pressure accumulator during the power stroke.

For piston position sensing, a magnetic steel plunger 40 is used together with a coil 42 which is excited with a relatively high frequency AC signal. The impedance of the coil will vary with the position of the magnetic plunger 40. While the variation in impedance with plunger position as measured may not be linear and/or the circuitry for sensing the impedance may not be linear, a calibration curve may readily be applied to linearize the output signal with piston position.

Figure 3:
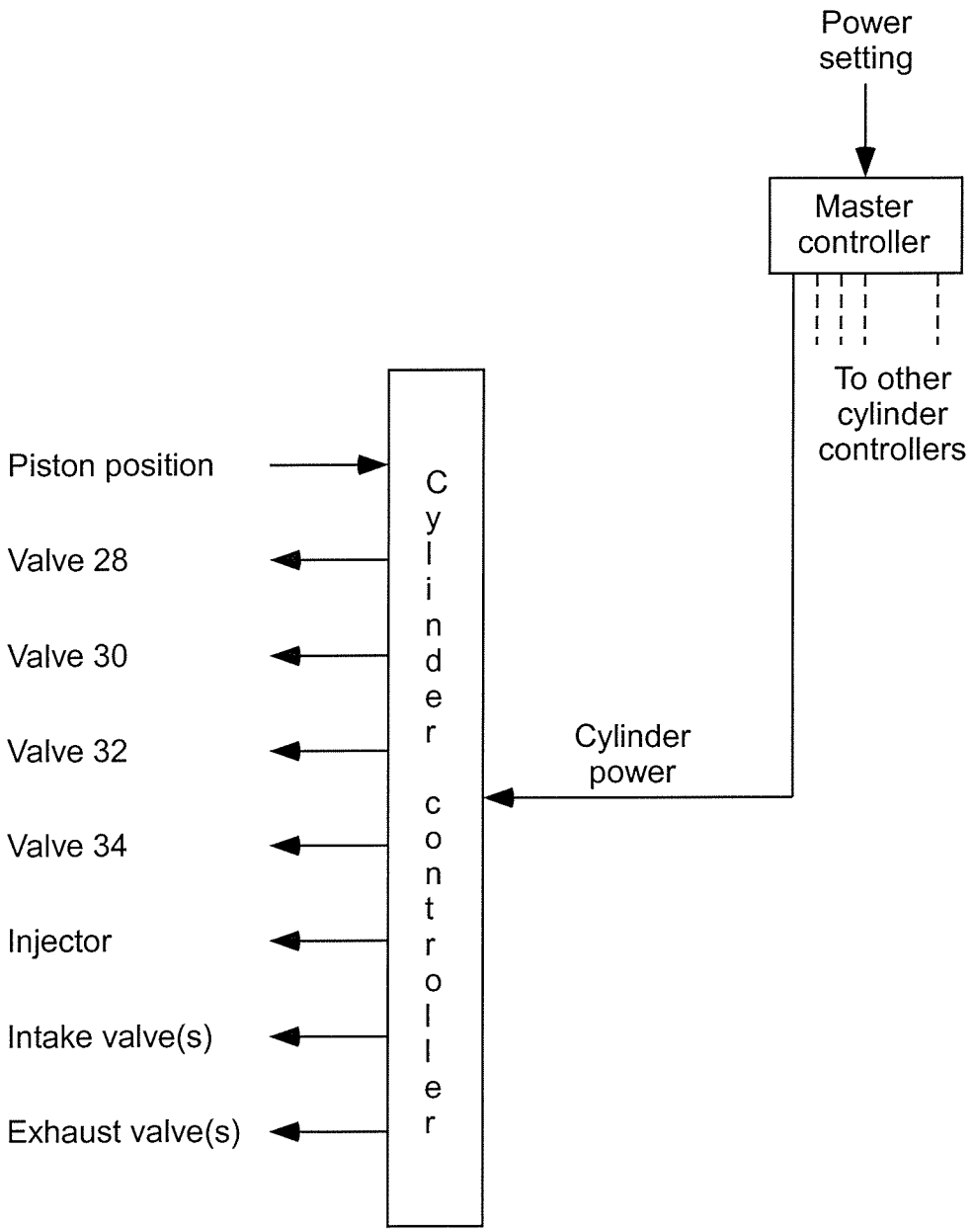
FIG. 3 presents an exemplary control system for the free piston engine and methods of the present invention.

Now referring to FIG. 3, an exemplary control system for a multi-cylinder free piston engine incorporating the present invention may be seen. This control system uses a cylinder controller for each cylinder of the free piston engine, with the cylinder controllers being controlled in turn by a master controller. In that regard, note that in a free piston engine of the type being described, any given cylinder may go from an off state wherein the piston 20 is at a fixed position to a full power state wherein the free piston engine cylinder is operating at maximum power within one or two strokes of the piston 20. Further, there typically will be a most efficient operating condition for a piston in a free piston engine which may be expressed primarily in terms of piston position and velocity profiles. Accordingly by way of example, under light load conditions one or more cylinders may be entirely turned off, or alternatively, all cylinders operated though with a pause between operating cycles, such as a pause at the bottom dead center piston position after an intake stroke before later resuming operation. Ignition could be sensed by a pressure sensor extending into the combustion chamber, though ignition may be more easily sensed by sensing pressure or pressure changes in the hydraulic fluid in the region below the hydraulic piston 24, and cycle to cycle adjustments made to maintain ignition at the desired piston position. Note that in a free piston engine, the free piston may continue a compression stroke until ignition occurs, so that as long as fuel is available, the cycle to cycle adjustments are in effect controlling the piston position when ignition occurs, effectively controlling what is being called the top dead center free piston position.

The free piston engine may be configured and operated as a conventional four stroke compression ignition engine, a two stroke compression ignition engine or in accordance with other operating cycles, as desired. Compression ignition at or near a piston top dead center position may be assured cycle to cycle adjustment in the operation of the intake and exhaust valves INT and EXH. In a free piston engine, a compression stroke may be continued, provided fuel is available, until ignition occurs, so the cycle to cycle adjustment is essentially controlling the top dead center free piston position at which compression ignition occurs. Ignition may be sensed by putting a pressure sensor in each free piston combustion chamber, though a simpler and less expensive way of sensing ignition is to sense the rapid rise in pressure in the hydraulic fluid under hydraulic piston 24.

As shown in FIG. 3, in the exemplary control system a cylinder power command is provided to each cylinder controller by way of a cylinder power command signal. The cylinder controller generally monitors the position and thus the velocity of piston 20 and controls valves 28, 30, 32 and 34, as well as the fuel injector INJ, the intake valves INT and the exhaust valves EXH to operate that cylinder in accordance with the commanded cylinder power. The cylinder controller would know the proper piston position and velocity profiles to operate that cylinder in the most efficient way to provide the commanded power, which may include imposing pauses between operating cycles as required and as hereinbefore described. However these operating conditions might also be variable, typically through the master controller, to take into consideration engine temperature, air temperature, etc.

Also as shown in FIG. 3, the master controller itself in this exemplary embodiment is responsive to a power setting which may be, by way of example, an accelerator position in a vehicle. In that regard, the phrase power setting is used in a broad sense and might be responsive to a speed or a change of speed of the device driven by the hydraulic output of the free piston engine, such as when driving an AC electric generator having a variable load thereon. The master controller can control additional cylinder controllers in a multi-cylinder engine and can stop pistons 20 in a number of cylinders to obtain the most efficient operation of the remaining operating cylinders based on the load requirements at the time. Of course the control system of FIG. 3 is merely an example, and a suitable control system can be realized in many different configurations.

As pointed out before, the ability to operate the valves (28, 30, 32 and 34 in the exemplary embodiment) in a time period which is much shorter than an individual stroke of the free piston makes feasible the modulation of the valving between coupling to the high pressure rail or accumulator and the low pressure rail or accumulator, and to the vent (reservoir) when the hydraulic fluid is being discharged to the vent. Preferably each piston will follow predetermined position and velocity profiles, either fixed for all operation of the engine or dependent on the specific engine operating conditions. The position profiles particularly define the top dead center and bottom dead center piston positions, with the velocity profiles particularly defining the preferred piston velocities between these two end positions.

In theory, one could modulate the operation of the valves at a high frequency to accurately hold the piston velocities to the desired velocity profile. However there are some losses associated with the actuation of the valves that limits the number of actuations that are practical per piston stroke. Aside from the energy required to operate the valves, it is particularly important that hydraulic fluid flow never be blocked when the respective free piston is moving. This means for instance that when switching between the high pressure accumulator and the low pressure accumulator, one must allow momentary coupling together of the high and low pressure accumulators. It is for this reason that it is preferred to use 3-way valves for valves 28, 30, 32 and 34 rather than two, 2-way valves for each, as a 3-way valve can be designed to have a momentary coupling that is adequate but not excessive, and is not subject to problems of the possible difference in speed of operation of two 2-way valves. Consequently to avoid excessive losses due to valve actuation, the control system should allow significant deviation from the intended or ideal velocity profile to limit the amount of valve actuation losses commensurate with the added losses that large excursions from the intended velocity profile will cause. In that regard, an ideal velocity profile can be easily experimentally established, and in fact different profiles might be used dependent on whether maximum efficiency or maximum power is desired.

Thus the present invention has a number of aspects, which aspects may be practiced alone or in various combinations or sub-combinations, as desired. While a preferred embodiment of the present invention has been disclosed and described herein for purposes of illustration and not for purposes of limitation, it will be understood by those skilled in the art that various changes in form and detail may be made therein without departing from the spirit and scope of the invention.

What is claimed is:

1. A free piston engine comprising:

a free piston having a first diameter in a cylinder with a combustion chamber on a first side of the free piston and a piston rod having a second diameter fastened to a second side of the free piston and extending to a single second piston having a third diameter smaller than the first diameter, but larger than the second diameter;

the single second piston extending into a hydraulic cylinder, the single second piston having a first hydraulic area defined by the third diameter in a first hydraulic chamber, and a second hydraulic area defined by an area between the third diameter and the second diameter in a second hydraulic chamber;

a position sensor for providing an output responsive to the position of the free piston;

a high pressure accumulator with a first pressure;

a low pressure accumulator with a second pressure that is less than the first pressure; and a reservoir having a third pressure that is less than the first and second pressures;

first valving for controllably coupling the first hydraulic chamber to any one of the reservoir, the low pressure accumulator or the high pressure accumulator independent of the direction of motion of the free piston;

second valving for controllably coupling the second hydraulic chamber to any one of the reservoir, the low pressure accumulator or the high pressure accumulator when the free piston is moving toward a top of the combustion chamber, and for controllably coupling the second hydraulic chamber to any one of the low pressure accumulator or the high pressure accumulator when the free piston is moving away from the top of the combustion chamber;

the first and second valving being independently controllable;

the first and second valving being designed to avoid a momentary hydraulic lock when switching between any two valve positions.

2. The free piston engine of claim 1 wherein the first valving comprises two, three-way valves.

3. The free piston engine of claim 1 wherein the first and second valving each comprise two, three-way valves.

4. The free piston engine of claim 1 wherein the second valving comprises two, three-way valves.

5. The free piston engine of claim 1 wherein the combustion chamber includes at least one intake valve, at least one exhaust valve, and a fuel injector.

6. The free piston engine of claim 5 wherein the intake valve, the exhaust valve and the fuel injector are all electronically controlled.

7. The free piston engine of claim 5 wherein the intake valve, the exhaust valve and the fuel injector are all hydraulically actuated.

8. The free piston engine of claim 5 wherein the intake valve, the exhaust valve and the fuel injector are all operated to achieve compression ignition at or near a piston top dead center position.

9. The free piston engine of claim 1 further comprising a control system for controlling motion of the free piston through control of the valving, including position and velocity profiles of the free piston responsive to an output of the position sensor.

10. The free piston engine of claim 9 wherein the control system controls the valving to control end positions of the free piston, and a deviation of the velocity of the free piston from the velocity profile.

11. The free piston engine of claim 10 wherein the control system controls the valving so that the first and second hydraulic chambers can exhaust a hydraulic fluid to the reservoir, but cannot attempt to withdraw hydraulic fluid from the reservoir.

12. The free piston engine of claim 1 further comprising a hydraulic motor coupled to the high pressure accumulator, the low pressure accumulator and the reservoir to provide a shaft power output.

13. The free piston engine of claim 12 wherein the hydraulic motor comprises a one or more hydraulic motor pistons coupled to a crankshaft.

14. The free piston engine of claim 13 wherein the hydraulic motor further comprises third valving coupled between the high pressure accumulator, the low pressure accumulator and the reservoir for controlling a hydraulic pressure on one side of the hydraulic motor pistons to control an output of the hydraulic motor.

15. The free piston engine of claim 1 wherein the second valving is for controllably coupling the second hydraulic chamber to any one of the reservoir, the low pressure accumulator or the high pressure accumulator.

16. A method of operating a free piston engine having a free piston of a first diameter for motion within a free piston cylinder and having a combustion chamber on a first side of the free piston comprising:

coupling a piston rod having a second diameter fastened to a second side of the free piston and extending to a single second piston having a third diameter smaller than the first diameter, but larger that the second diameter;

the single second piston extending into a hydraulic cylinder, the second piston having a first hydraulic area defined by the third diameter in a first hydraulic chamber, and a second hydraulic area defined by the area between the third diameter and the second diameter in a second hydraulic chamber;

providing a high pressure accumulator, a low pressure accumulator and a reservoir each having a pressure, wherein the pressure of the reservoir is less than the pressure of the low pressure accumulator, which is less than the pressure of the high pressure accumulator;

providing first valving for controllably coupling the first hydraulic chamber to any one of the reservoir, the low pressure accumulator and or the high pressure accumulator;

providing second valving for controllably coupling the second hydraulic chamber to any one of the reservoir, the low pressure accumulator or the high pressure accumulator when the free piston is moving toward a top of the combustion chamber, and for controllably coupling the second hydraulic chamber to any one of the low pressure accumulator or the high pressure accumulator when the free piston is moving away the top of the combustion chamber, and independently controlling the first and second valving to control a top dead center position and a bottom dead center position of the free piston, and to control a velocity profile of the free piston during a motion between the top dead center and the bottom dead center positions of the free piston responsive to a position sensor that is responsive to the position of the free piston responsive to a position sensor that is responsive to the position of the free piston;

the first and second valving being configured to avoid a momentary hydraulic lock when switching between their two valve positions.

17. The method of claim 16 wherein controlling the first and second valving to control the top dead center and bottom dead center positions of the free piston, and to control the velocity profile of the free piston during the motion between the top dead center and bottom dead center positions comprises modulating the control of the valving to control the top dead center and bottom dead center positions of the free piston, and to limit the excursion of the velocity profile of the free piston from an intended velocity profile.

18. The method of claim 16 wherein the valving is controlled so that the first and second hydraulic chambers can exhaust a hydraulic fluid to the reservoir, but cannot attempt to withdraw hydraulic fluid from the reservoir.

19. The method of claim 16 wherein the second valving is for controllably coupling the second hydraulic chamber to any one of the reservoir, the low pressure accumulator or the high pressure accumulator.

* * * * *